US007740245B2

(12) United States Patent
Tarantino

(10) Patent No.: US 7,740,245 B2
(45) Date of Patent: Jun. 22, 2010

(54) METHOD OF PRESENTING AND PLAYING GAME WHERE WINNING HAND TRIGGERS ENHANCED AWARD OPPORTUNITY IN SUBSEQUENT GAME

(75) Inventor: Elia Rocco Tarantino, Las Vegas, NV (US)

(73) Assignee: Patent Investment Corporation, Reno, NV (US)

( * ) Notice: Subject to any disclaimer, the term of this patent is extended or adjusted under 35 U.S.C. 154(b) by 426 days.

(21) Appl. No.: 11/406,814

(22) Filed: Apr. 19, 2006

(65) Prior Publication Data

US 2007/0265051 A1 Nov. 15, 2007

(51) Int. Cl.
*A63F 1/00* (2006.01)

(52) U.S. Cl. ..... 273/292; 463/16

(58) Field of Classification Search ..... 463/25, 463/16, 35, 40–42; 273/143 R, 292, 139, 273/85, 138.1; 705/14.65, 15, 400
See application file for complete search history.

(56) References Cited

U.S. PATENT DOCUMENTS

| | | | | |
|---|---|---|---|---|
| 4,743,022 | A * | 5/1988 | Wood | 463/13 |
| 5,356,140 | A | 10/1994 | Dabrowski et al. | |
| 5,868,618 | A * | 2/1999 | Netley et al. | 463/13 |
| 6,179,711 | B1 | 1/2001 | Yoseloff | |
| 6,569,013 | B1 | 5/2003 | Taylor | |
| 6,605,002 | B2 * | 8/2003 | Baerlocher | 463/25 |
| 6,638,163 | B2 * | 10/2003 | Moody | 463/13 |
| 6,729,621 | B2 * | 5/2004 | Moody | 273/292 |
| 7,059,965 | B2 * | 6/2006 | Jackson | 463/16 |
| 7,201,654 | B1 * | 4/2007 | Jarvis et al. | 463/13 |
| 2002/0160827 | A1 * | 10/2002 | Slomiany et al. | 463/16 |
| 2003/0134673 | A1 * | 7/2003 | Moody | 463/20 |
| 2003/0207707 | A1 * | 11/2003 | Slomiany et al. | 463/16 |
| 2004/0002376 | A1 * | 1/2004 | Swift et al. | 463/25 |
| 2004/0017043 | A1 * | 1/2004 | Moody | 273/292 |
| 2004/0224743 | A1 * | 11/2004 | Tarantino | 463/11 |
| 2005/0026668 | A1 * | 2/2005 | Tarantino | 463/13 |
| 2005/0037839 | A1 * | 2/2005 | Yoseloff | 463/25 |
| 2005/0110215 | A1 * | 5/2005 | Jackson | 273/292 |

(Continued)

OTHER PUBLICATIONS

Terry Murphy, "Midwest Casino Guide—VP Does VP in Windsor", http://www.midwestcasinoguide.com/show_article.php?article_id=17&author_id=3, ©2007, 2003, 2002, Midwest Casino Guide, 6 pages.

(Continued)

*Primary Examiner*—Peter DungBa Vo
*Assistant Examiner*—Masud Ahmed
(74) *Attorney, Agent, or Firm*—Weide & Miller, Ltd.

(57) ABSTRACT

In a method of presenting or playing a wagering game, if a winning outcome is received, a first award is awarded and one or more awards associated with one or more winnings outcomes for the game are then enhanced for potential award in a subsequent game or games. In one embodiment, a base paytable or award structure is modified or enhanced, such as by adjusting awards or associating multipliers or bonus values, to create an enhanced paytable or award structure. The enhanced paytable or award structure may remain in effect for one subsequent game, a set number of games or a time, or until the same or another winning outcome is received in a subsequent game. The game which is presented may vary, such as being a wagering game of video poker, video slots or even a table game.

13 Claims, 3 Drawing Sheets

U.S. PATENT DOCUMENTS

| | | | | |
|---|---|---|---|---|
| 2005/0124402 | A1* | 6/2005 | Miller | 463/13 |
| 2006/0084500 | A1* | 4/2006 | Baerlocher et al. | 463/25 |
| 2006/0135239 | A1* | 6/2006 | David | 463/13 |
| 2006/0148557 | A1* | 7/2006 | Okada | 463/25 |
| 2006/0178183 | A1* | 8/2006 | Van Asdale | 463/13 |
| 2007/0135193 | A1 | 6/2007 | Nicely | |
| 2007/0218982 | A1* | 9/2007 | Baerlocher | 463/27 |

OTHER PUBLICATIONS

"IGT Back It Up™ Poker", http://www.igt.com/GamingGroup/Games/game_detail.asp?toggle=ovr&pid=5&type_id=3349&pl=, ©2002-2007 IGT, 2 pages.

* cited by examiner

METHOD OF PRESENTING AND PLAYING GAME WHERE WINNING HAND TRIGGERS ENHANCED AWARD OPPORTUNITY IN SUBSEQUENT GAME

FIELD OF THE INVENTION

The present invention relates to games offering opportunities for awards and, more particularly, wagering type games.

BACKGROUND OF THE INVENTION

Wagering games continue to increase in popularity. As such, new games continue to be developed. In general, it is desirable to develop games which are interesting to players. In some instances, the entire format of the game is changed. For example, entirely new games are sometimes developed. In other situations, existing games are modified or enhanced. Such a modification may be a change in the method of game play.

One popular game feature is the "bonus." In general, most games offer basic payout or winning award for a winning outcome. It has been found, however, that many players enjoy the opportunity to continue play or to be paid enhanced winnings. In a very common game configuration, a game defines a number of predetermined winning outcomes. For one or more of those outcomes, the player is either provided the opportunity to play a "bonus round" as part of that same game for the opportunity to win a bonus award, or is directly paid a larger award.

These award structures are still very limited in their excitement. For example, the offering of such bonuses do little to entice a player to play additional games. In addition, these bonus structures are pre-set, meaning that they are the same every time. For example, a player of a game offering a bonus level generally must obtain a particular winning set of symbols for a chance to play the bonus round. That particular set of symbols does not change. In addition, these bonuses are often known before play of the game begins. For example, when a player initiates a game, they may be informed that they will be entitled to a 2× bonus for all wins.

A wagering game which is exciting to players and which is beneficial to casinos is desirable.

SUMMARY OF THE INVENTION

The present invention comprises methods of playing and presenting games, including apparatus and systems for presenting games.

In one embodiment of a method of presenting a game, if a winning outcome is received, a first award is awarded and one or more awards associated with one or more winning outcomes for the game are then enhanced for potential award in a subsequent game or games. In one embodiment, the award for the particular winning outcome of the first game is enhanced. In another embodiment, multiple awards associated with multiple winning outcomes, such as that for the winning outcome and all other winning outcomes of a lower rank are enhanced. Preferably, if the winning outcome is received in the one or more subsequent games, the one or more enhanced values are returned to their original values. In addition, in a preferred embodiment, if a winning outcome is not received in a predetermined number of subsequent games, the one or more enhanced values are returned to their original values.

In one embodiment, awards are enhanced by increasing them. Awards may be increased in absolute value, by application of a multiplier, by addition of a bonus or other means. In one embodiment, an award is enhanced by doubling its value. In one embodiment, awards are increased by adjusting a "paytable" of winning results and associated payouts or awards.

In one embodiment, the enhanced award(s) remains in effect for at least one subsequent game. The enhanced award(s) may remain in effect for multiple games. Other awards may be enhanced if winning outcomes are received in the one or more subsequent games. In one embodiment, the amount of an enhanced award, such as the size of a multiplier, may decrease from its enhanced value to an original value.

The game which is presented may be a game of video poker having a plurality of predetermined winning outcomes associated with a set of first awards. If the outcome of a first game is a winning outcome, the award for that outcome may be increased from a first value to a second value. This second value may remain in effect until the player either receives the same winning outcome or a predetermined number of games are presented or played to obtain that award.

In accordance with the method of the invention, receipt of a winning outcome in one game triggers the opportunity for a larger award for obtaining one or more winning outcomes in a second or later game. In this manner, if a player wins a first game, they are enticed to play one or more additional games in an attempt to win a larger award for one or more winning outcomes of the later game(s).

Further objects, features, and advantages of the present invention over the prior art will become apparent from the detailed description of the drawings which follows, when considered with the attached figures.

DETAILED DESCRIPTION OF THE INVENTION

The invention comprises methods of presenting and playing games, as well as apparatus for implementing the method(s). In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises methods of presenting and playing games. One aspect of the invention is a wagering game offering a player an opportunity for winnings for one or more predetermined winning outcomes. In the event of a winning outcome, the game offers an opportunity for an enhanced award for one or more winning outcomes in one or more subsequently played games. In one embodiment, a winning outcome of a game causes one or more base or normally awarded winning values to increase. A player may play the game at a later time and, if a winning outcome associated with one or more of the increased awards is received, the player is awarded that increased award.

Figure 3:
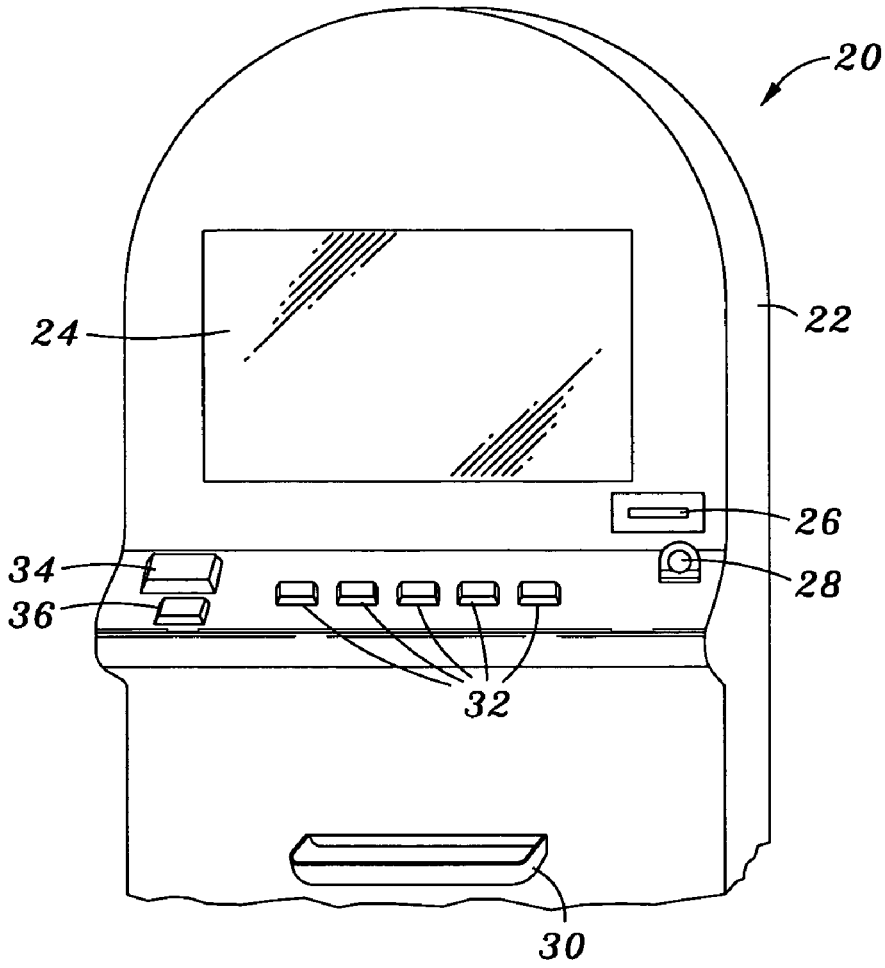
FIG. 3 illustrates a gaming machine in accordance with an embodiment of the invention.

In one embodiment, the one or more games of the invention are implemented by and presented to a player with a gaming machine. FIG. 3 illustrates a gaming machine 20 in accordance with one embodiment of the invention. As illustrated, the gaming machine 20 includes a housing 22 for enclosing/supporting various components of the gaming machine. The gaming machine 20 may include one or more display devices, such as a video display 24, for displaying game information. This information may comprise, as detailed below, images of cards or other indicia, and associated game information such as a paytable. Speakers (not shown) or other devices may be provided for generating sound associated with the game.

In one embodiment, the game is played as a wager-type game which requires that a player place a bet or wager to play the game. As illustrated, the gaming machine 20 may include one or more devices or means for accepting value, such as a bill validator/acceptor 26 for accepting paper currency and/or a coin acceptor 28 for accepting coins. Other means of accepting value for wagering, such as a credit card reader or a ticket reader, may be provided. The player may wager some or all of this value, such as by providing input regarding a wager (such as by pressing a "bet one" or "bet max" button, which effectuates placing a wager from the provided value).

Preferably, if the player is a winner of the game, then the player is provided an award. The award may comprise physical monies, such as bills or coins, or may comprise representative value, such as credits. An award of winnings in the form of coins may be paid to the player via a coin tray 30. Value may also be provided to the player by a printed receipt, a card or the like, as is well known in the art of "cashless" gaming.

Preferably, the gaming machine 20 includes means for a player to provide input. In one embodiment, this means comprises one or more buttons. For example, a plurality of card "hold" or "select" buttons 32 may be provided for permitting a player to hold/select cards in a hand. A deal/draw button 34 permits a player to indicate that they wish the game to start or to draw replacement cards. A bet button 36 is provided for a player to select the amount to bet on a particular game. Other or additional types of input devices may be utilized, such as a touch-screen, joystick, rotating arm or the like.

A game controller (not shown) is provided for controlling the various devices of the gaming machine and for providing game information. For example, the game controller may be arranged to generate video and audio data for presentation by the display 24 and speakers of the gaming machine 20. The game controller may be arranged to detect a signal from the coin acceptor indicating the receipt of coins or other value, and may be arranged to cause a coin delivery mechanism to deliver coins from a coin hopper to the coin tray 30, or otherwise credit or dispense winnings. The controller may also be configured to detect the placing of a wager and then present a game in response thereto. The game controller may be configured to accept game data generated at a remote location, such as a remote server, and effect presentation of a game using that data.

It will be appreciated that the gaming machine 20 may have a variety of configurations and the gaming machine 20 illustrated and described above is but an example of a device for implementing the game of the present invention. For example, the gaming machine 20 may include one or more rotating reels, as is common to "slot"-type machines. The gaming machine 20 may be associated with a network and receive game information remotely and may transmit information, such as payout and game play information, to a remote location. Such a network may include one or more wireless or wired communication links.

The gaming machine 20 may also have other forms than that illustrated. For example, the gaming machine 20 might comprise a computing device, such as a home computer. The home computer may be configured to receive game information over the Internet or other communication link to a game server. The gaming machine 20 might also comprise a handheld device such as a mobile telephone or PDA.

As will be appreciated later, the game of the invention may also be presented via other than a gaming machine. For example, the game may be presented as a "table" game.

One aspect of the invention comprises methods of playing or presenting games. One embodiment of a method of presenting a game will be described with reference to FIG. 1.

As indicated above, in a preferred embodiment, a game of the invention is a wagering type game. As such, in a step S1, the game preferably includes the step of accepting a wager. The wager may be accepted from a player. In one embodiment, the step of accepting a wager comprises two components. First, a player provides value. Second, the player designates a portion of that value to comprise a wager. For example, a player my provide coins, bills, a value ticket or other value or source of value. In the case of a gaming machine, that value or source of value may be input to the machine. In the case of a gaming table, that value or source of value might be provided to a dealer. In the case of a gaming machine, the value may be represented as credits. The player may then wager some or all of those credits, such as by providing a "wager" input such as depressing a "bet one" or "bet max" button. In the case of a table game, the player value may be represented by gaming chips. The player may place a wager by transferring one or more of those chips to the game provider (such as a dealer).

In a step S2, the method preferably includes the step of determining if a base or enhanced paytable or award structure is in effect. If not, then a basic paytable is preferably utilized, as in step S3. If so, then in a step S4, it is determined if that paytable or award structure is to remain in effect. If not, then the base paytable or award structure is preferably utilized. If so, then the enhanced paytable or award structure is utilized, as in step S5.

In one embodiment, as detailed below, the criteria for determining whether an enhanced paytable or award structure remains in effect may vary. For example, such criteria may depend upon the number of games played after a particular enhanced paytable or award structure is placed into effect or the outcome of one or more games.

Regardless of which paytable or award structure is utilized (i.e. in steps S3 or S5), in a step S6, a game is presented to one or more players. The game may be of a variety of types. For example, the game may be a video-poker game, a slot-type game, a table game such as poker or blackjack, or other games now known or later developed. The presentation of the game may include the presentation of game information, such as the display of video-generated card images, the rotating of reels to display slot indicia, the dealing of physical cards or the like. The presentation of the game may alternatively or, in addition, comprise the acceptance of various inputs from the player(s). For example, a player may press a "deal" button of a gaming machine to cause cards to be displayed, and may press one or more "hold/draw" buttons to cause cards to be replaced (as in the case of "draw" type poker).

Preferably, the game presented to the player has at least two outcomes. One or more, but preferably not all, of those outcomes are designated winning outcomes. Each winning outcome has an associated award. The awards may the same or different. In one embodiment, the awards comprise credits which are representative of monetary value.

In a step S6, the outcome of the game is determined. This preferably comprises determining whether the outcome of the game is one of the predetermined winning outcomes (or is otherwise a "non-winning" or "losing" outcome). If the outcome of the game is not a winning outcome (i.e. a "losing" outcome), then the game preferably ends at step S8. In one embodiment, in such instance, the player loses or forfeits their wager.

If the outcome of the game is a winning outcome, then in a step S9, the player is preferably awarded winnings for that outcome. The winnings may be defined by a paytable of winning outcomes and associated awards. As indicated above, the particular paytable or other award structure which is in effect may vary. As also indicated above, such an award may comprise an award of credits, monies or other prizes or the like.

In a step S10, in one embodiment, it is determined if the winning outcome is a "game changing" outcome. If not, then the game ends, as in step S8. As will be appreciated in more detail below, such an outcome may be one which "deactivates" an enhanced paytable or award structure, or one which causes an enhanced paytable or award structure to be implemented.

In step S11, it is determined if the winning outcome is "gaming changing", then it is determined if an enhanced paytable or award structure is in effect. If so, then in step S12, a change is preferably made back to the base paytable or award structure. If not, then a change is preferably made to the enhanced pay table or award structure, as in step S13.

Thereafter, the game preferably ends, as in step S8.

It will be appreciated that the above-referenced description represents one embodiment of a game. The game may have other features and may be implemented in other fashions. For example, the game may be implemented using a "flow" or logic which differs from that detailed above.

Some particular examples of methods of presenting and playing games in accordance with the invention will now be described. These examples will provide additional insight into various aspects of the invention.

Figure 2:
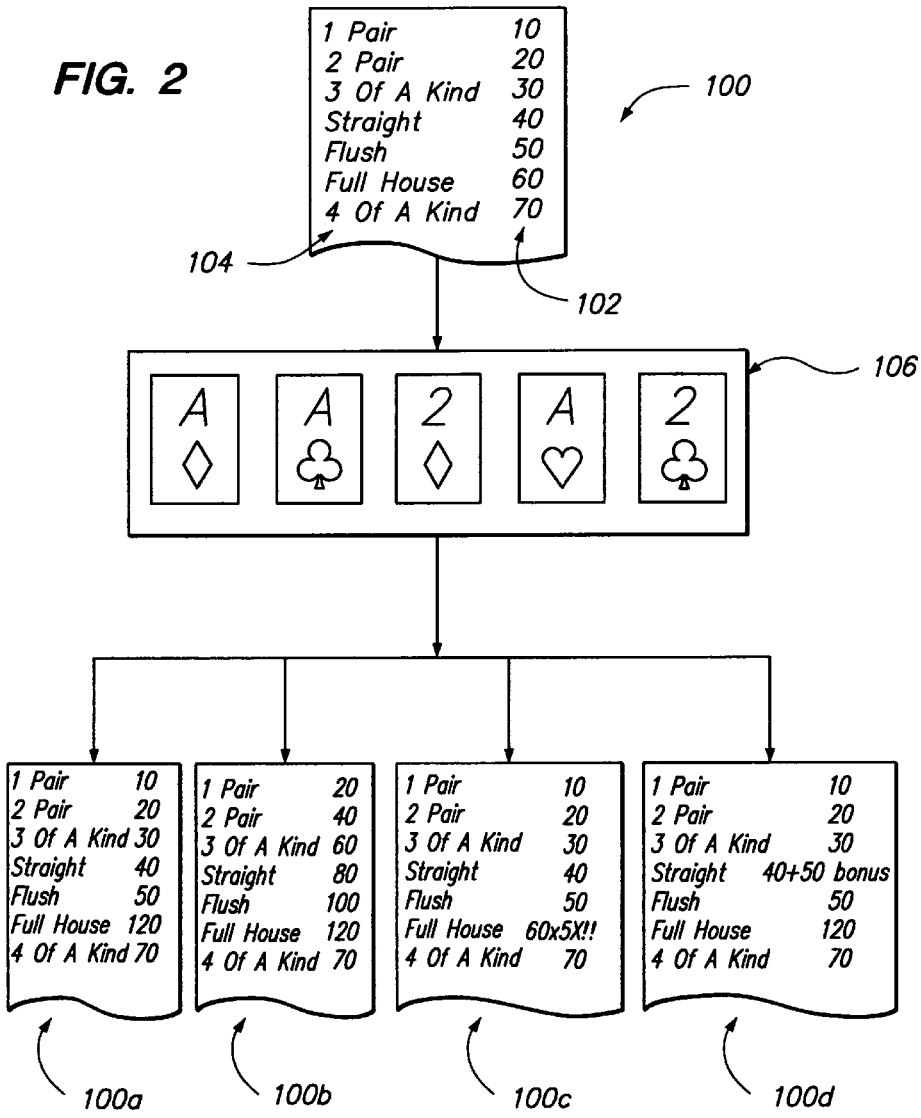
FIG. 2 illustrates an example of a base paytable or award structure, a particular game outcome and a variety of enhanced paytables or award structures which may be yielded in accordance with a game of the invention.

Referring to FIG. 2, in one embodiment, a game may have a base paytable or award structure 100. In the case of a video poker game, the paytable may provide for the award of winnings 102 for various predetermined winning poker hands 104. As illustrated, such hands or outcomes 104 might comprise "one pair" (such as a pair of Jacks or better), "two pair", "three of a kind" and the like. Of course, the particular outcomes which are designated as winning may vary, such as depending upon the particular game which is being presented.

As illustrated, each predetermined winning outcome 104 preferably has an associated winning award 102. The award may comprise, for example, a number of credits representative of monetary value.

A player may play the game and receive an outcome 106. As detailed above, the player is preferably required to place a wager in order to the play the game. Where the game is a game of video poker, the outcome of the game may comprise a poker hand. As illustrated, the outcome is a hand of five poker cards. Of course, the outcome of the game will depend upon the particular game which is being presented.

As indicated above, if the outcome of the game is a winning outcome, then the player is preferably awarded an award. In the illustrated example, the outcome of the game is a "full house" poker hand. The player is preferably awarded 60 credits in accordance with the paytable or award structure 100 which was then in effect during play of that game.

Next, it is determined if the winning outcome is a specific outcome. If one embodiment, a specified outcome comprises one or more of the predetermined winning outcomes. For example, a specified outcome might comprise all winning outcomes from "one pair" up through a "full house" (thus excluding winning hands such as "four of a kind."

If so, then it is determined if the paytable or award structure is preferably changed. In one embodiment, referring to FIG. 2, in the event the base paytable or award structure is active and a specified winning outcome is received, then a different paytable or award structure is activated.

FIG. 2 illustrates various different paytables or award structures which may be activated. In a first embodiment, the new paytable or award structure 100*a* may include a different payout or award for the particular outcome which was just received. In the example provided where the outcome was a "full house" poker hand, the award for that particular outcome may be adjusted. Preferably, the adjustment is an increase in the size or value of the award. In a most preferred embodiment, the increase is at least a doubling of the award. For example, where the base award was 60 credits for "full house", the new award may be 120 credits.

In another embodiment, the new paytable or award structure 100*b* may include different payouts or awards for various outcomes. In one embodiment, the award associated with the outcome just received and all others of lesser rank or award than that just received may be adjusted. In the example provided where the outcome was a "full house" then the awards associated with that outcome and all other winning hands of lower ranks are adjusted. Preferably, the adjustment is an increase and most preferably an increase of at least two times the original or base award. In one embodiment the amount by which the particular awards are adjusted need not be the same.

It will be appreciated that different "rules" may apply to the particular specific outcomes. For example, when one particular specified outcome is received, it may be that the new paytable or award is adjusted only as to that particular award. However, if another specified award is received, the paytable or award structure may be adjusted as to awards associated with multiple different outcomes.

The paytable or award structure may be adjusted in a variety of ways. In one embodiment, the particular award values may be changed. Referring to FIG. 2, in one embodiment the base award value may remain the same but the paytable or award structure 100*c* may include a multiplier. The multiplier may apply to a particular award or multiple awards. Still referring to FIG. 2, in one embodiment the base award value may remain the same but the paytable or award structure 100*d* may include one or more bonus amounts or values. Again, the bonus value or values may apply to a particular award or multiple awards.

It will be appreciated that the paytables or awards need not be in a "table" form but are simply one way to illustrate that the particular award or value for one or more outcomes has been changed and that, should that outcome be received when playing a future game, the player would be awarded the corresponding "new" amount.

In one embodiment, once a new paytable or award structure is in effect, a player has an opportunity to be awarded an award in accordance with that new paytable or award structure via later play of the game. In one embodiment, the new paytable or award structure remains in effect until the player receives a specified outcome. Preferably, once the player receives the same specified outcome which caused the new paytable or award structure to go into effect, that same specified outcome causes the base or old paytable or award structure to go back into effect, as in steps S11 and S13 of the flow diagram described above. For example, if a player received a specified winning outcome of a "full house", the player might be awarded 60 credits and the paytable or award might be changed so that the next occurrence thereof entitled the player to an award of 120 credits. Upon the next game play occurrence in which the player received another "full house" outcome, the player would be paid 120 credits and the old paytable or award structure (providing for payment of 60 credits) would go back into effect.

Figure 1:
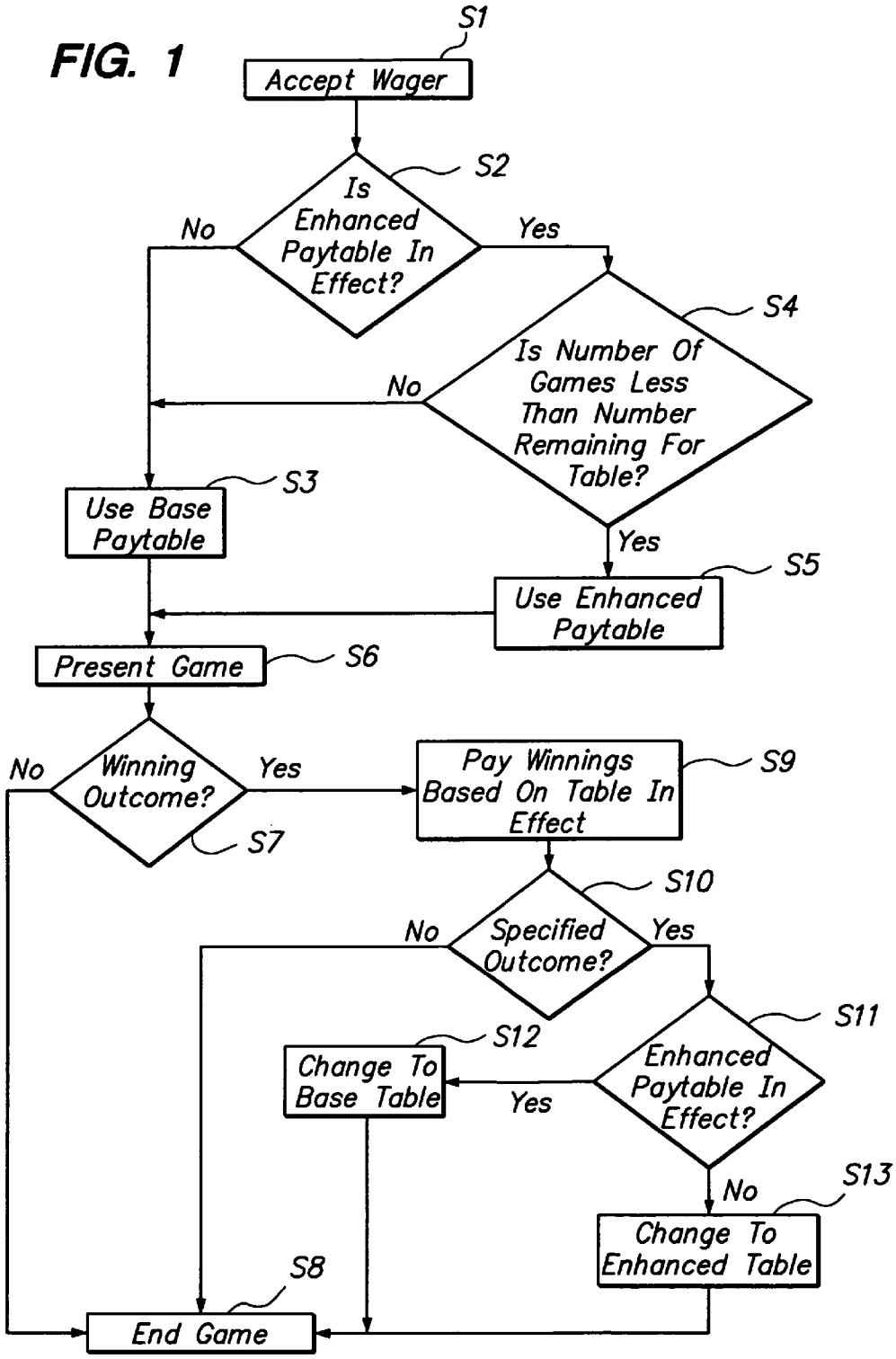
FIG. 1 is a flow diagram illustrating a method of game presentation/play in accordance with an embodiment of the invention.

In one embodiment, as detailed in step S4 of the flow diagram illustrated in FIG. 1, the game may be configured so that the new paytable or award structure remains in effect only for a certain number of plays. For example, the new paytable or award structure may remain in effect only for the next five (5) games (or any other number of games), rather than until the specific outcome is received again. Of course, the new paytable or award structure might remain in effect only for a certain period of time or based upon other criteria. For example, if a player received a "full house" and the paytable or award structure was changed, the player might be provided only five games to receive another "full house" outcome or else the paytable or award structure would revert back to the base paytable or award structure.

Various additional features and aspects of the invention will now be described. In one embodiment the paytable or award structure may be modified in multiple ways and those modifications may "phase" in and out depending upon the specified outcomes. For example, if a player received a specified outcome such as a "full house" the paytable or award structure might be modified to that of the paytable 100*c* illustrated in FIG. 2. The player might then have five games to obtain another "full house" outcome and be awarded the enhanced award (of 60 times the 5× multiplier, or 300 credits). If during the next game the player received the specified outcome of "3 of a Kind" (which might be a winning result entitling the player to a payout or award for that particular game) then the paytable or award structure might be further modified so that the award for the "3 of a Kind" outcome is doubled, so long as such outcome is received in the next five games. If the player did not receive a "full house" as a result of playing the five games after receiving that particular outcome, then the enhanced paytable or award structure associated with that particular result would "phase out", but during the next game the enhanced paytable or award structure for the "3 of a Kind" would still be in effect. In such a situation, the "logic" or "flow" of the game may be modified from that in FIG. 1 so that the method includes one or more steps for implementing multiple enhanced paytables or award structures, and for determining which such structures are in effect for particular games (as they may "phase out" at different times). Of course, such features may be implemented in various manners.

In other words, various enhanced paytable or award structures might overlap for one or more games. The particular enhanced paytables or award structures might be different. For example, upon receiving a particular outcome, the awards for particular outcomes might double. Upon receiving another outcome, that already enhanced paytable or award structure might be modified so that a multiplier applies to the already doubled awards.

In one embodiment, the enhanced paytable or award structure may be varied. For example, if a player is provided an opportunity to receive a specified award again during a certain number of subsequent games, the award for that outcome may change after each game in which that outcome is not received. For example, a player may receive a "full house" outcome and the paytable or award structure may be adjusted with a 5× bonus multiplier. If the player does not receive a "full house" outcome after the next game, the multiplier might be adjusted, such as reduced to "4×."

The multiplier or other bonus value or other paytable or award adjustment may be pre-set (such doubling awards or a 2× multiplier) or they might vary. For example, a multiplier might be randomly generated and applied to an award. The particular award adjustments also need not be the same. For example, one award might be doubled or subject to a multiplier of 5×, while another award might be tripled or subject to a multiplier of 2×. The multiplier, bonus awards or the like might be part of game play. For example, in the play of video poker, one or more multiplier or bonus cards might be used. If one of those cards are dealt or selected, the associated multiplier or bonus might be applied.

In one embodiment, the enhanced award might comprise a secondary game, such as a free game which may yield a bonus payout. In one embodiment, the enhanced award structure might comprise larger awards for certain outcomes and reduced or no awards for other outcomes, or by increasing the number of winning outcomes (such as by making some otherwise non-winning outcomes winning outcomes for one or more future games). For example, upon receiving a specified "full house" outcome, the awards for all winning outcomes with a lower rank may be reduced by 50%, but the award for a "full house" may then be increased, such as by doubling or tripling it.

In one embodiment, the specified outcome may comprise a variety of events. Relative to a video poker game, the specified outcome which results in an enhanced award structure may comprise other than a traditional poker hand. For example, a player may received a particular set of cards, such as cards with the values 2, 4, 6, 8 and 10 in the five card positions. Then if the player receives that same set of cards in the next game or games, the player might be awarded an enhanced award. Similarly, a specified outcome may comprise a combination of slot symbols which is otherwise not a winning set of symbols but which, if received, triggers and opportunity for an enhanced award in the next game or games.

The "enhanced" awards may be funded in various manners. In one embodiment, a player may be required to place a minimum wager in order for the above-described game feature to be enabled. For example, a player might place a single credit wager to play video poker. The player might be given the opportunity for the enhanced paytable or award structure if they place a five credit wager. The player might also be required to place an additional or separate wager in order to activate the feature. For example, the player may play the game by placing a wager of between one and five credits. If a player places an additional (or $6^{th}$) credit wager, the enhanced features described herein may be activated.

In one embodiment, a player's opportunity for an enhanced award my depend on other criteria, such as whether they are using a player tracking system associated with a gaming machine. Such systems are well known and have applicability to both gaming machines and table games.

As described above, an enhanced paytable or award structure may be applied to any future games. Thus, a first player might play a game which causes the enhanced paytable or award structure to go into effect. If that player leaves the gaming machine, table or the like, a second player may then have the opportunity to play subsequent games with the opportunity to win the enhanced award(s).

In another embodiment, an enhanced pay table or award structure is associated with a particular player. For example, a player may log into a player tracking system (such as with a card or PIN). If an enhanced paytable or award structure is in effect, the player may stop playing and log out (such as by removing their card). The gaming machine may then reset to its base mode for the next player. When the player "logs in" again, the gaming machine may reconfigure itself to offer the enhanced paytable or award structure. Of course, such may be implemented physically at a gaming table or such may be implemented in other ways.

As indicated, the adjustment may occur only for specified outcomes. For example, a paytable or award structure adjustment might be made for video poker games with outcomes of "three of a kind" or better, but not simply "a pair" or "a pair of a Jacks or better."

Game information may be displayed in a various fashions. For example, the paytable or award structure may be displayed automatically, or at least when adjusted. A multiplier or bonus value might be displayed in various fashions, such as in a manner in which the values "change" and then stop at a final applied value.

In one embodiment, if a player receives a specified outcome, the player may be entitled to select one or more outcomes to be enhanced. The player may then be provided one or more later game opportunities to obtain the particular selected winning outcomes to win the enhanced awards associated therewith.

It will thus be appreciated that various combinations of the features or principals described above may be utilized. In such circumstances, the method of game presentation may vary from that illustrated in FIG. 1.

Another aspect of the invention is a gaming machine, device or system which is configured to present the game of the invention. In one embodiment, the gaming machine is configured to present a game, preferably in response to a player placing a wager. A controller of the machine may either generate or accept game data and display game information via a display to the player. In the event the outcome of the game is a winning outcome, the player may be awarded an award. Preferably, the controller is then configured to present one or more additional or later games using an enhanced paytable or award structure, in the manner described above.

As also indicated above, the method of the invention may be implemented at a gaming table. For example, a game of poker may be presented to a player using physical cards. The method of play may follow that detailed above.

A number of aspects of the invention will now be appreciated. The game of the invention offers heightened player excitement. If the player receives a winning outcome, the player is not only awarded an award or winnings, but the player may be offered the opportunity to win a larger award in the future. The player is then enticed to play additional games in an attempt to obtain the one or more outcomes having enhanced awards.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. In a method of presenting games at a gaming machine comprising the machine-implemented steps of:

accepting a base wager and optionally at least one secondary wager;

presenting a first wagering game, said first wagering game having an associated pay table defining a plurality of winning outcomes including one or more qualifying outcomes, each winning outcome having a first associated award;

determining an outcome of said first wagering game;

if said outcome of said first wagering game is a losing outcome, terminating said first wagering game;

if said outcome of said first wagering game is one of said winning outcomes, paying said first associated award to said player in accordance with said pay table and if said outcome is also a one of said one or more qualifying outcomes, defining said outcome as a particular qualifying outcome and increasing an award for said outcome to a second increased award above said first associated award defined by said pay table if said outcome occurs within a predetermined plurality of second wagering games, regardless of whether an outcome of one or more of said second wagering games is a losing outcome; and presenting one or more second wagering games and if an outcome of said one or more second wagering games is identical to said particular qualifying outcome and occurs within said predetermined plurality of second wagering games, paying said second increased award to said player and then resetting an award for said outcome back to said first associated award defined by said pay table.

2. The method in accordance with claim 1 wherein said award for said winning outcome is increased to a second increased award only if said player placed said secondary wager.

3. The method in accordance with claim 1 comprising increasing said second increased award for one of said one or more qualifying outcomes each time one of said at least one secondary wager is placed on said one of said one or more qualifying outcomes.

4. The method in accordance with claim 1 further comprising:

increasing said award for at least one other winning outcome to a second increased award above said first associated award if said outcome is one of said one or more qualifying outcomes and said outcome is one of said winning outcomes; and paying said second increased award for said at least one other winning outcome if said at least one other winning outcome occurs within said predetermined plurality of second wagering games.

5. The method in accordance with claim 1 wherein said first wagering game and said one or more second wagering games are one of the following wagering games: video poker, a table game, or a slot game.

6. The method in accordance with claim 1 wherein the said one or more second wagering games are different wagering games than said first wagering game.

7. In a method of presenting games at a gaming machine comprising the machine-implemented steps of:

accepting a wager;

presenting a first wagering game, said first wagering game having an associated pay table defining a plurality of winning outcomes, said pay table also defining an award to each for said plurality of winning outcomes;

determining the outcome of said first wagering game;

if said outcome of said first wagering game is a losing outcome, terminating said first wagering game;

if said outcome of said first wagering game is one of said winning outcomes, paying said award to a player based upon said pay table and defining said outcome as a repeat winning outcome for a predefined plurality of subsequent wagering games after said first wagering game, wherein for each subsequent wagering game until said predefined plurality of subsequent wagering games is reached or until said repeat winning outcome occurs, for each outcome that is one of said winning outcomes and not identical to said repeat winning outcome, awarding an award to said player based upon said pay table, and for an outcome identical to said repeat winning outcome, awarding an enhanced award to said player which is higher than the award for said outcome in accordance with said pay table, regardless of whether an outcome of said predefined plurality of subsequent wagering games is one of said winning outcomes.

8. The method in accordance with claim 7 further comprising optionally collecting a second wager, wherein said enhanced award is only awarded to said player if said second wager is made.

9. The method in accordance with claim 7 wherein said first wagering game and said one or more second wagering games are one of the following wagering games: video poker, a table game, or a slot game.

10. The method in accordance with claim 7 wherein the said one or more subsequent wagering games are different wagering games than said first wagering game.

11. In a method of presenting video poker games at a gaming machine comprising the machine-implemented steps of:

accepting a base wager;

presenting a video poker game, said video poker game having an associated pay table defining a plurality of winning outcomes including one or more qualifying outcomes, said pay table also defining an award for each of said winning outcomes;

determining an outcome of said video poker game;

terminating said video poker game if said outcome is a losing outcome;

if said outcome is a winning outcome, paying said award associated with said outcome in accordance with said pay table, and if said outcome is also one of said qualifying outcomes, activating an enhanced pay table defining one or more enhanced awards for said outcome and optionally for at least one other winning outcome; and for a plurality of subsequent games:

determining the outcome of said subsequent game and paying said award based upon said enhanced pay table if said outcome is one of said winning outcomes; and deactivating said enhanced pay table if said enhanced pay table has been activated for said plurality of subsequent games or if said outcome is identical to said particular qualifying outcome which activated said enhanced pay table.

12. The method in accordance with claim 11 further comprising accepting an optional second wager, wherein said enhanced paytable may be activated only if said optional second wager is made or if said base wager is equal to or greater than a predetermined minimum wager amount.

13. The method in accordance with claim 11 further comprising decreasing at least one of said one or more enhanced awards defined by said enhanced pay table after each subsequent video poker game has been played.

* * * * *